US007507171B2

(12) United States Patent
Gait

(10) Patent No.: US 7,507,171 B2
(45) **Date of Patent: *Mar. 24, 2009**

(54) LACROSSE POCKET HAVING SHOOTING STRING GUIDE TUBES BETWEEN THE RUNNERS

(75) Inventor: Paul Gait, Altamont, NY (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 86 days.

This patent is subject to a terminal disclaimer.

(21) Appl. No.: 11/734,268

(22) Filed: Apr. 11, 2007

(65) Prior Publication Data

US 2007/0191153 A1 Aug. 16, 2007

Related U.S. Application Data

(62) Division of application No. 11/223,057, filed on Sep. 9, 2005, now Pat. No. 7,390,275.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724

See application file for complete search history.

(56) References Cited

U.S. PATENT DOCUMENTS

| | | | |
|---|---|---|---|
| 1,279,720 | A | 9/1918 | Lewis |
| 2,710,753 | A | 6/1955 | Lockwood |
| 4,022,477 | A | 5/1977 | Pool |
| 4,037,841 | A | 7/1977 | Lewis, Jr. |
| 4,049,273 | A | 9/1977 | Pool |
| 4,138,111 | A | 2/1979 | Rule |
| 4,153,251 | A | 5/1979 | Pond |
| 4,270,756 | A | 6/1981 | Ahlenfeld et al. |
| 4,273,331 | A | 6/1981 | Fischer |
| 4,460,178 | A | 7/1984 | Ulman |
| 4,657,260 | A | 4/1987 | Brine, Jr. |
| 4,861,042 | A | 8/1989 | Trettin |
| 4,938,480 | A | 7/1990 | Lods |
| 5,048,843 | A | 9/1991 | Dorfi et al. |
| 5,178,397 | A | 1/1993 | Brine, Jr. |
| 5,425,541 | A | 6/1995 | Ambros |
| 5,568,925 | A | 10/1996 | Morrow et al. |
| 5,651,549 | A | 7/1997 | Dill et al. |

(Continued)

*Primary Examiner*—Gene Kim
*Assistant Examiner*—M Chambers
(74) *Attorney, Agent, or Firm*—Waddey & Patterson, P.C.; Phillip E. Walker

(57) ABSTRACT

A pocket for a lacrosse head including a scoop, a throat, first and second sides, a front and a back. The pocket comprises first and second runners engaging the scoop and the throat, wherein the runners are positioned substantially adjacent to each other. A tubular member can be positioned between the first and second runners and a cross member can traverse the tubular member. The first runner restricts movement of the tubular member relative to the first side while the second runner restricts movement of the tubular member relative to the second side. The cross member can be connected to the first and second sides of the lacrosse head and move relative to the first and second sides independent of the first or second runner. Alternately, the cross member can engage the first runner to the second runner wherein the cross member restricts movement of the first runner relative to the second runner.

15 Claims, 13 Drawing Sheets

U.S. PATENT DOCUMENTS

| | | | | |
|---|---|---|---|---|
| 5,707,306 | A | 1/1998 | Boden | |
| 5,935,026 | A | 8/1999 | Dill et al. | |
| 5,938,550 | A | 8/1999 | Hexemer et al. | |
| 6,066,056 | A | 5/2000 | Morrow | |
| 6,447,410 | B2 | 9/2002 | Crawford | |
| 6,561,932 | B2 | 5/2003 | Morrow et al. | |
| 6,966,854 | B1 * | 11/2005 | Gait | 473/513 |
| 2001/0044347 | A1 * | 11/2001 | Crawford | 473/513 |

* cited by examiner

LACROSSE POCKET HAVING SHOOTING STRING GUIDE TUBES BETWEEN THE RUNNERS

This application is a divisional application of co-pending U.S. application Ser. No. 11/223,057 filed Sep. 9, 2005 entitled "Lacrosse Pocket Having Shooting String Guide Tubes Between The Runners", which is hereby incorporated by reference in its entirety.

I, Paul Gait, a citizen of Canada, residing at 5 Normandy Dr., Altamont, N.Y. 12009; have invented a new and useful "Lacrosse Pocket Having Shooting String Guide Tubes Between The Runners."

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or disclosed herein are hereby incorporated by reference in their entirety.

BACKGROUND OF THE INVENTION

The present invention relates generally to a lacrosse stick. More specifically the present invention relates to an improved lacrosse pocket for a lacrosse head. The improvements include specialized pieces that run substantially along the longitudinal length of the lacrosse head wherein the specialized pieces include a multi-material construction and openings spaced along the length of the specialized pieces to facilitate construction of the pocket and attachment of the pocket to the lacrosse head. Other improvements include tubular elements laterally spaced across the width of the lacrosse head. These tubular elements facilitate adjustment of the lacrosse pocket in relation to the lacrosse head and facilitate better control of the lacrosse ball within the lacrosse head and shooting or passing accuracy of the lacrosse ball from the lacrosse head.

It will be appreciated by those of ordinary skill in the art that lacrosse is a fast-growing sport. It will further be appreciated that lacrosse sticks are essential to playing the game. A lacrosse stick is comprised of a handle portion attached to a head. The lacrosse head is a collection, catching, or basket type, element that consists generally of a frame and a pocket. The frame of the lacrosse head is usually comprised of polymers, such as DuPont Xytl brand nylon. The lacrosse frame includes an open, or upper, side for catching and discharging a lacrosse ball and a lower side to which a net or pocket is attached for holding the ball. The lacrosse frame is used to impart the force upon the ball in order to shoot or pass the ball. The lacrosse frame generally has a throat section that includes a ball stop for impacting a ball and a socket for receiving the handle. A pair of sidewalls is attached to the throat section proximate to the ball stop and are joined distal from the throat section by a lip, or scoop section.

Traditionally, a pocket for a lacrosse head is hand assembled by a player using two or more cross members, or strings, with two or more longitudinal members, or runners. The runners and strings work together to form a pocket and are secured to the frame of the head using a combination of the runners, the cross pieces, and ties that attach to the cross pieces and the frame of the lacrosse head. Additionally, a lacrosse pocket can include other lateral members spanning the distance between the sides of the lacrosse head. These lateral members, which are often called shooting strings, are used to adjust the depth and tension within the pocket and allow a particular player to customize the lacrosse head to his or her preferred shooting style and technique.

In the game of lacrosse, the head is used to catch the ball, hold the ball, and pass or shoot the ball. To this end, there have been several attempts to improve the lacrosse head to enhance the playing of lacrosse.

Additionally, a lacrosse players' pocket may take months to "break in." During this period, the player utilizes the stick and becomes accustomed specifically to the pocket and how the pocket subtly changes during the course of play. A player will make adjustments to the pocket to make it personalized to his or her use. As such, the pockets can be described as the most crucial part of the lacrosse stick because it is the basis for good ball control, accurate passing, and fast accurate shooting.

There are currently at least three popular ways to construct lacrosse pockets:

1-Traditional: braided nylon or polyester lace woven between sidewall and longitudinal runners (sometimes referred to as thongs). The runners are traditionally leather or braided nylon and run between the scoop and inside throat area. The pocket is woven to the head as it is being created. Many traditional pockets comprise four runners, cross lacing, and side wall stringing. These materials are typically hand woven or strung in the traditional manner to form a pocket. The stringing and/or weaving of a traditional pocket is very labor intensive is typically done by hand.

Additionally, stringing a traditional pocket requires skill. Lacrosse players who do not have stringing skills are often required to hire independents that do. Alternatively, one can buy a head factory strung by the lacrosse manufacturer. If a lacrosse stick is purchased unstrung (without a pocket), then a stringing "kit" must be purchased. This kit includes material for weaving a traditional pocket.

Today, the traditional pocket is standard to the industry and is the most popular pocket among lacrosse players.

2-Mesh: machine woven nylon mesh is pre-manufactured and later attached to the sidewalls, scoop and inside throat areas. The mesh pockets consist of a polyester or nylon material woven together to create a diamond mesh (much like a mesh gymnastic bag). This mesh material is machine made and is the integral body of the pocket. A mesh material only allows for one consistent weave pattern.

3-Traditional/Mesh: a head that is strung with a combination of pre-manufactured mesh, hand woven lace and longitudinal runners.

The following U.S. Patent generally describe the art of lacrosse sticks and heads, and are expressly incorporated herein by reference: U.S. Pat. Nos. 6,561,932; 6,066,056; 5,938,550; 5,935,026; 5,651,549; 5,568,925; 5,425,541; 5,178,397; 5,048,843; 4,657,260; 4,270,756; 4,138,111; 4,049,273; and 4,037,841.

Additionally, U.S. Pat. No. 6,447,410 has a head for a lacrosse stick that includes a web for receiving the ball wherein the web is attached to the frame of the head and includes one or more tube like shooting string elements extending between the sidewalls of the lacrosse head. Additionally, this patent discloses one or more tube like thong elements extending longitudinally between the scoop and the stop of the frame. In this patent, all of these tube-like elements extend completely across the width or the length of the lacrosse head. This patent fails to realize the shortcomings of solid tube like materials spanning the entire width or length of the lacrosse pocket. These thong type elements are required to be weaved in and out of the other runners or cross members which causes uncontrolled undulations in the pocket that can alter the control, shooting, and passing of the ball from the lacrosse head so constructed.

Additionally, the prior art fails to appreciate the use of longitudinal members, or runners, composed of multiple materials that facilitate construction of the runners as well as a more controlled surface for the ball to engage and traverse during play of the game, such as when a ball is controlled within the lacrosse head or expelled from the lacrosse head.

In addition, the prior art fails to realize the need for elements within the runners and cross members that facilitate construction of the lacrosse pocket. This is especially true in view in light of the normal manner in which a lacrosse pocket is made such that each string and/or runner must be completely intertwined and wrapped around at least once, if not multiple times, other elements within the lacrosse head in order to make the lacrosse pocket. This task is made more difficult by the fact that these intertwined movements and lacing should be substantially uniformly spaced throughout the lacrosse head in order to facilitate proper control and expulsion of the ball during a game.

What is needed is a lacrosse head that includes a pocket that has elements to facilitate control of a ball while the ball is in the lacrosse head and expulsion of the ball from the lacrosse head. Preferably, this needed lacrosse pocket includes runners and/or cross pieces having specialized elements that aid in the construction of the pocket and provide a more uniform starting pocket. Additionally, this needed lacrosse pocket can include runners and strings made of multiple materials used to facilitate construction of the pocket and control of the ball when within the pocket and when expelled from the pocket. Additionally, this needed lacrosse head can include control elements substantially uniformly positioned throughout the lacrosse head to enhance the feel of the ball in the lacrosse head and the control of a ball when contained in the lacrosse head and when discharged from the lacrosse head. This needed lacrosse head is presently lacking in the art.

BRIEF SUMMARY OF THE INVENTION

Included herein is a pocket for a lacrosse head wherein the pocket comprises first and second runners, each runner engaging the scoop and the throat wherein the runners are positioned substantially adjacent to each other. At least one tubular member can be positioned between the first and second runners and at least one cross member can traverse the tubular member. The first runner restricts movement of the tubular member relative to the first side while the second runner restricts movement of the tubular member relative to the second side.

The cross member can be connected to the first and second sides of the lacrosse head, which can be described as a shooting string for a lacrosse head. The cross member moves relative to the first and second sides independent of the first or second runner in this embodiment. Alternately, the cross member can engage the first runner to the second runner wherein the cross member restricts movement of the first runner relative to the second runner, which can be described as a cross piece or cross lace of a lacrosse head.

Also included is a pocket for a lacrosse head. The lacrosse head includes a scoop, a throat, first and second sides, a front and a back. The pocket comprises at least one runner having a first layer attached to a second layer and substantially flat first and second sections. At least one opening is positioned between the first and second sections wherein at least one opening spaces the first layer from the second layer.

Preferably the first layer is sewn to the second layer adjacent to the opening and the first and second sections are sewn together. The first and second layers can be formed of a single piece of material folded on itself, wherein the single piece of material is attached together at the first and second sections to establish the at least one opening between the sections. Alternately, the first and second layers can be individual pieces of material attached at the first and second sections.

In a preferred embodiment, the first and second layers comprise multiple types of material. For example, each layer can include a polyurethane material substantially covering a braided material wherein the braided material is selected from the group consisting of leather, synthetic leather, and nylon.

The at least one runner can further include a longitudinal axis wherein each layer extends away from the longitudinal axis at the opening. At least one cross member can be positioned in the at least one opening wherein the at least one cross member can connect the first side of the lacrosse head to the second side.

The pocket can include first and second runners wherein each runner includes an opening and the cross member can be positioned in the openings to restrict movement of the first runner relative to the second runner. A tubular member can be positioned between the first and second runners such that the cross member traverses the tubular member between the first and second runners.

Also included is a pocket comprising at least one runner including a first layer having a polyurethane material attached to a braided material and a second layer having a polyurethane material attached to a braided material, wherein the braided material of the first layer engages the braided material of the second layer. Additionally, the polyurethane material of the first layer is separated from the polyurethane material of the second layer. As such, the polyurethane material of the first layer is positioned between the front of the lacrosse head and the braided material. Additionally, the polyurethane material of the second layer is positioned between the back of the lacrosse head and the braided material. The braided material of each layer can be exposed to the first and second sides of the lacrosse head.

The pocket can further include a plurality of attachment sections located on the runner and spaced along the longitudinal axis of the runner. A plurality of openings can be positioned along the longitudinal axis wherein each opening is positioned between two of the attachment sections. The openings space the braided material of the first layer from the braided material of the second layer. Additionally, a plurality of cross members can traverse one of the openings and connect the first side to the second side. Alternately, the cross members can connect adjacent runners.

It is therefore a general object of the present invention to provide an improved lacrosse head.

Another object of the present invention is to provide an improved lacrosse pocket for a lacrosse head.

Still another object of the present invention is to provide a lacrosse pocket having individual stringing elements composed of multiple materials.

Yet another object of the present invention is to provide a lacrosse pocket having string elements with portions that facilitate construction of a lacrosse pocket on a lacrosse head.

Another object of the present invention is to provide a lacrosse pocket having elements with apertures, or openings, used to construct the lacrosse pocket and enhance play of the game.

Yet still another object of the present invention is to provide a lacrosse pocket having substantially uniform tubular elements used to enhance the control and expulsion of a ball from the lacrosse head.

Still another object of the present invention is to provide a lacrosse pocket having individual tubular elements positioned between adjacent runners to facilitate an overall uniformly, or substantially symmetrically, aligned pocket for use in a lacrosse game.

Other objects, features, and advantages of the present invention will be readily apparent to those skilled in the art upon reading the following disclosure when taken in conjunction with the accompanying drawings.

BRIEF DESCRIPTION OF THE SEVERAL VIEWS OF THE DRAWINGS

FIG. 9 shows an example of the cross members strung between adjacent runners to engage and position adjacent runners with respect to each other.

FIG. 10 shows the cross members traversing tubular members between the runners.

FIG. 11 shows a cutaway of the tubular elements and an example of the engagement of the cross members to adjacent runners through the tubular members.

FIG. 12 shows tubular members spaced between adjacent runners in a mesh-type lacrosse net configuration.

DETAILED DESCRIPTION OF THE INVENTION

Figure 1:
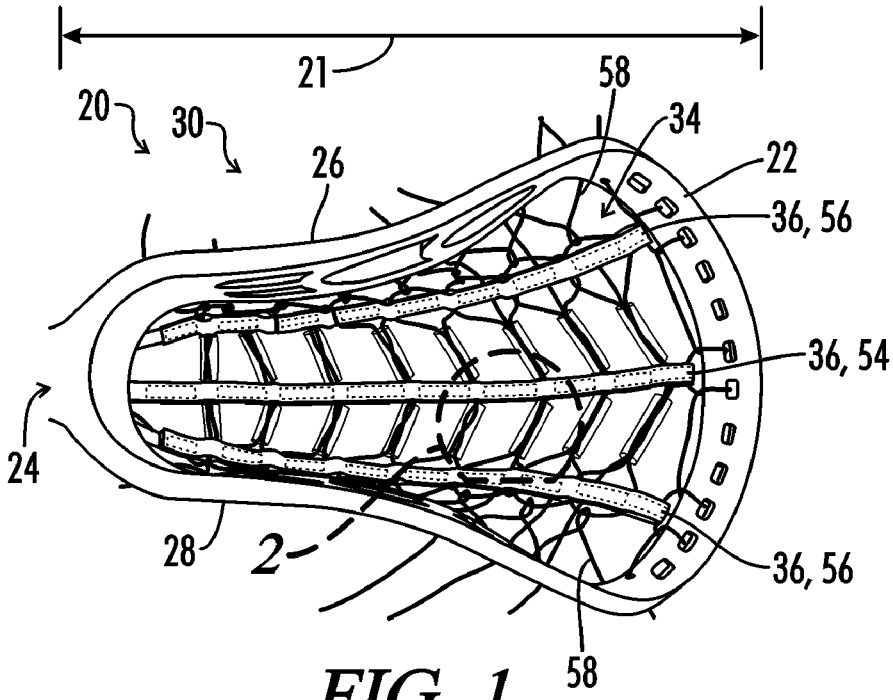
FIG. 1 is a front view of an embodiment of a lacrosse head made in accordance with the current disclosure.

Referring generally now to FIGS. 1-12, a lacrosse head made in accordance with the current disclosure is shown and generally designated by the numeral 20. The lacrosse head 20 is used in connection with a lacrosse handle (not shown) to comprise a lacrosse stick. The lacrosse head 20 includes a scoop 22, a throat 24, a first side 26, a second side 28, a front 30, and a back 32. The combination of the elements 22, 24, 26, 28, 30, and 32 can be described as a frame for the lacrosse head 20. The lacrosse head 20 also includes a pocket 34 used to control and discharge a lacrosse ball (not shown).

Figure 6:
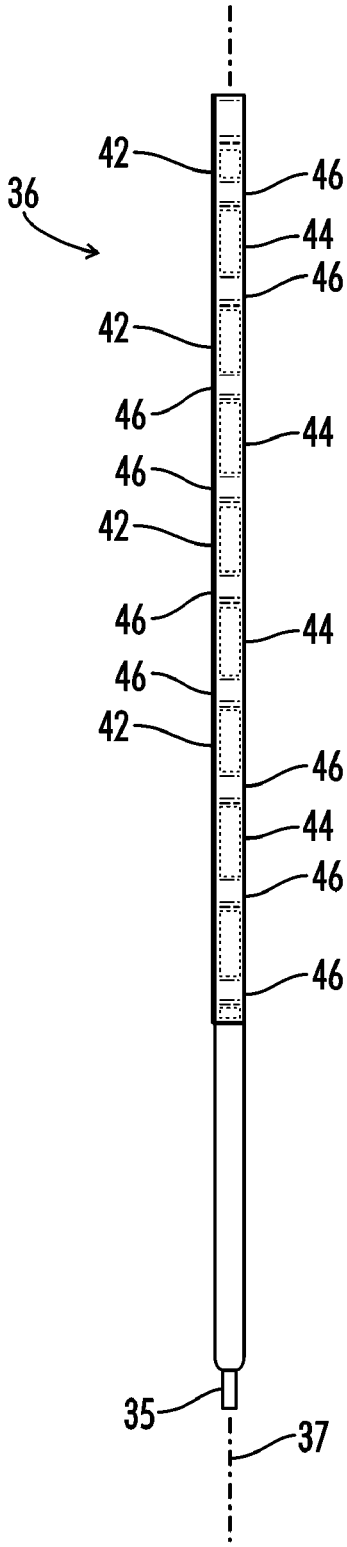
FIG. 6 is a front view of the runner of FIG. 5.
Figure 7:
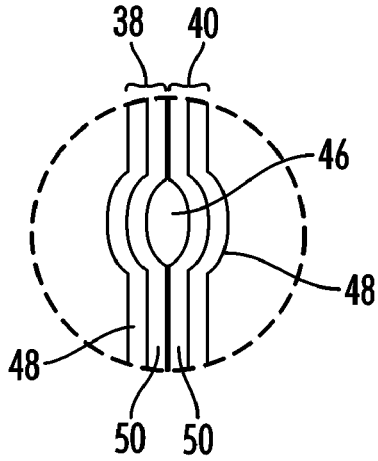
FIG. 7 is a detailed view of the area circled and labeled as "7" in FIG. 5.

In a preferred embodiment, the pocket 34 includes at least one runner 36 having a first layer 38 attached to a second layer 40. The runner 36 further includes a longitudinal axis 37 wherein each layer 38 and 40 extends away from the longitudinal axis 37 at least one opening 46. The opening 46 spaces the first layer 38 from the second layer 40 and can be described as a transverse slot between the layers 38 and 40, or an aperture between the layers 38 and 40. The first layer 38 can be sewn to the second layer 40 adjacent to the opening 46. An example of the runner 36 is illustrated in FIGS. 5-7.

Also included are a substantially flat first section 42 and a substantially flat second section 44, which can be described as attachment sections 42 and 44. The first and second sections 42 and 44 are geometrically defined as substantially flat in reference to the opening 46 positioned between the first and second sections 42 and 44. The physical nature of the first and second sections 42 and 44 are capable of providing a surface sufficiently flat enough to properly control and discharge a lacrosse ball from the pocket 34 or net 34. The first and second sections 42 and 44 can be sewn together.

The runner 36 can include multiple openings 36 positioned between multiple sections 42 and 44 along the longitudinal axis 37 of the runner 36. This facilitates multiple attachments between the runner 36 and the frame of the lacrosse head 20.

Figure 5:
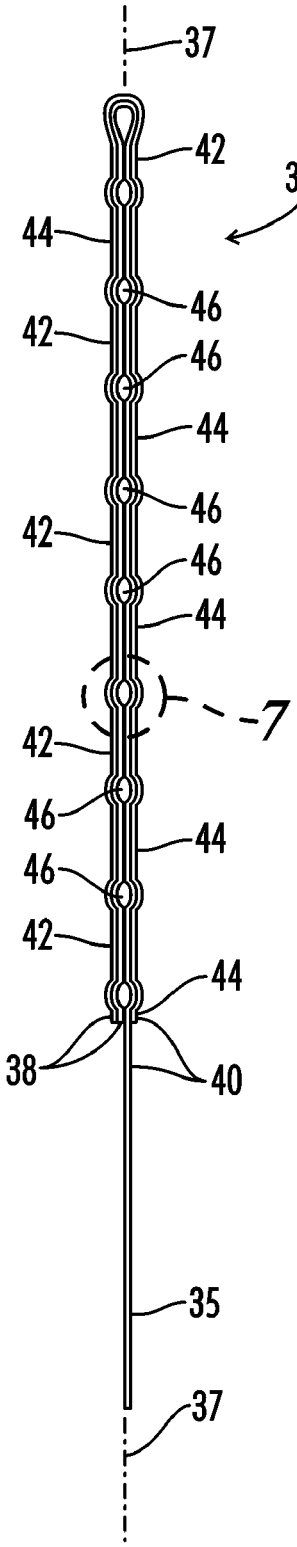
FIG. 5 is a side view of a runner made in accordance with the current disclosure.

The first and second layers 38 and 40 can be formed of a single piece of material folded on itself, as illustrated in FIG. 5. The single piece of material can attached together at the first and second sections 42 and 44 to establish the openings 36 between the sections 42 and 44. Alternately, the first and second layers 38 and 40 can be individual pieces of material attached at the first and second sections 42 and 44.

In a preferred embodiment, the runner 36 includes first and second layers 38 and 40 comprised of a first material 48 and a second material 50 wherein the second material 50 of the first layer 38 engages the second material 50 of the second layer 40. Preferably the first material 48 is polyurethane while the second material 50 is a braided material. The braided material can be selected from a group consisting of leather, synthetic leather, and nylon to provide the proper characteristics that enhance the construction and use of the pocket 34. The use of the multiple material increases the durability of the lacrosse pocket 34. Additionally, the fact that the dual layer 36 comprises first material 48 on both external sides of the runner 36 facilitates the reversal of the runner 36, and pocket 34 formed from the runners 36, such that both sides of the runner 36 can be used on the front side 30 of the lacrosse head 20 to engage the lacrosse ball.

The runner 36 of the pocket 34 can be configured such that the first material 48 of the first layer 38 is separated from the first material 48 of the second layer 40. The first material 48 of the first layer 38 can be positioned between the front 30 of a lacrosse head 20 and the second material 50. Correspondingly the first material 48 of the second layer 40 can be positioned between the back 32 of the lacrosse head 20 and the second material 50 of the second layer 40. Additionally, the second material 50 can be exposed to the first and second sides 26 and 28 of the lacrosse head 20. Additionally, the first material 48 of the first layer 38 can be separated from the first material 48 of the second layer 40 by the second material 50 of the first and second layers 38 and 40.

The pocket 34 further includes at least one cross member 52 wherein the cross member 52 is positioned in the opening 46. Multiple cross members 52 and openings 46 can be used to establish the pocket 34 and connect the pocket through the runners 36 and cross members 56 to the frame of a lacrosse head 20. A cross member 52 can pass through the opening 46 to engage the runner 36. Depending on the particular use of the cross member 52, the cross member 52 can continue to the opposite side 26 or 28 of the lacrosse head 20 or can loop around the runner 36 and return back towards itself.

A cross member 52 that connects the first side 26 to the second side 28 can be described as a shooting string 53. The shooting string 53 allows quick adjustment in the tension and depth of the pocket 34 relative to the frame of the cross head 20. Multiple shooting strings 53 can be used at strategic locations along the length 21 of a lacrosse head 20. The shooting strings 53 preferably tie in directly to the first and second sides 26 and 28 and traverse the openings 46 of the runners 36.

Figure 2:
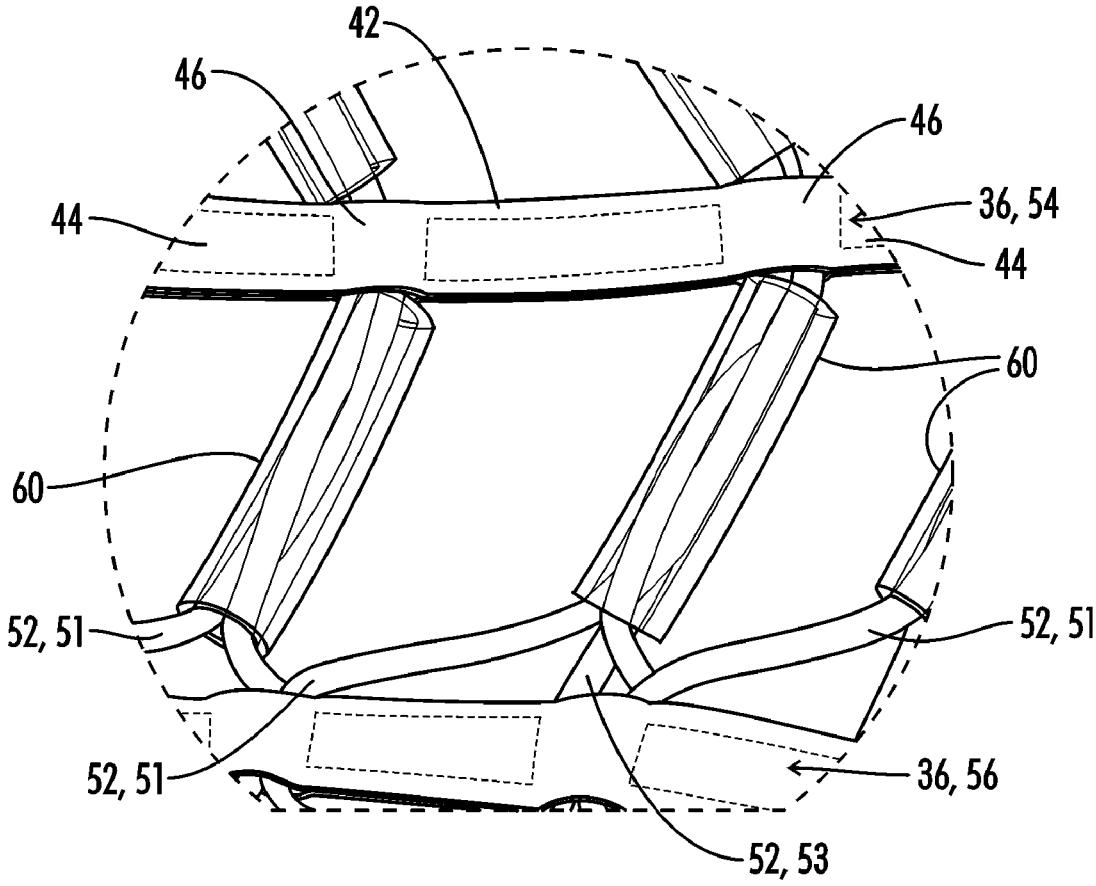
FIG. 2 is a detailed view of the area circled and labeled as "2" in FIG. 1.
Figure 3:
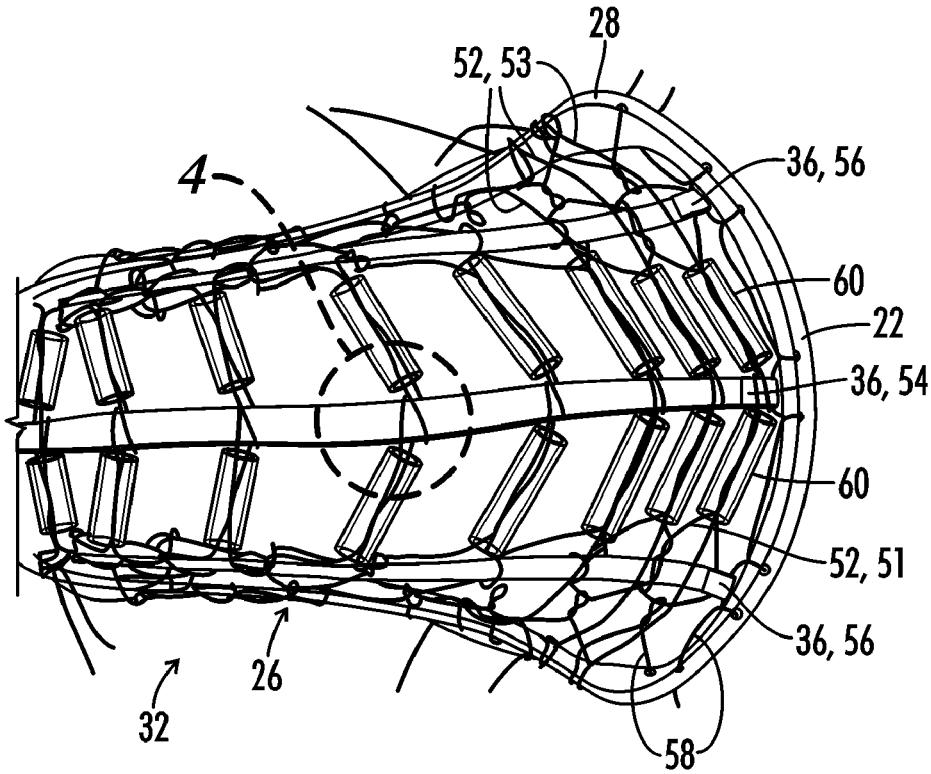
FIG. 3 is a bottom view of the lacrosse head shown in FIG. 1.
Figure 4:
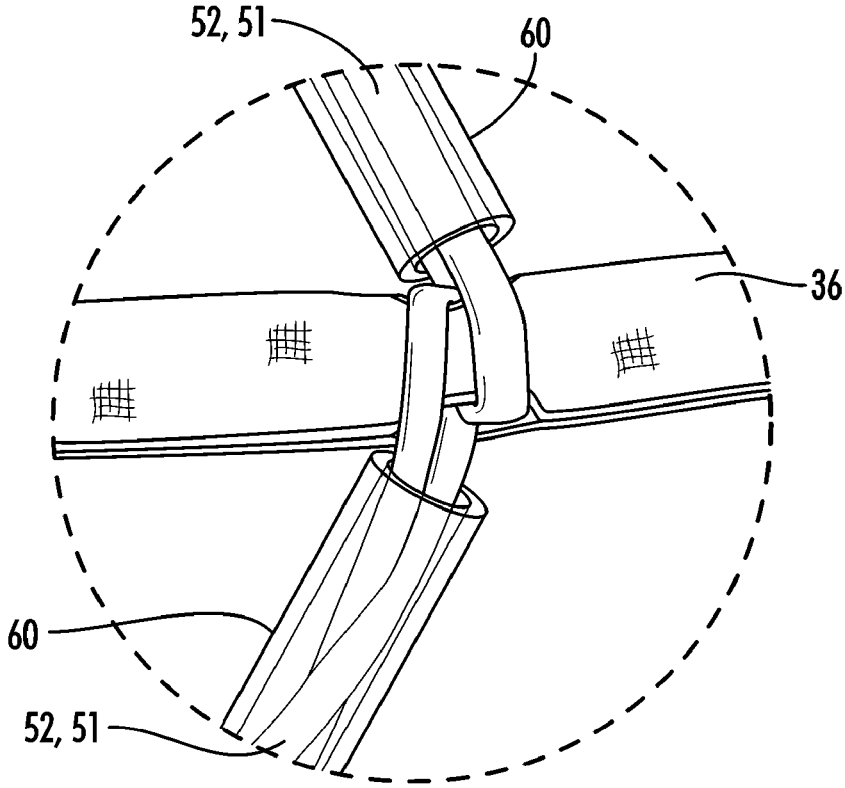
FIG. 4 is a detailed view of the region circled and labeled as "4" in FIG. 3.
Figure 8:
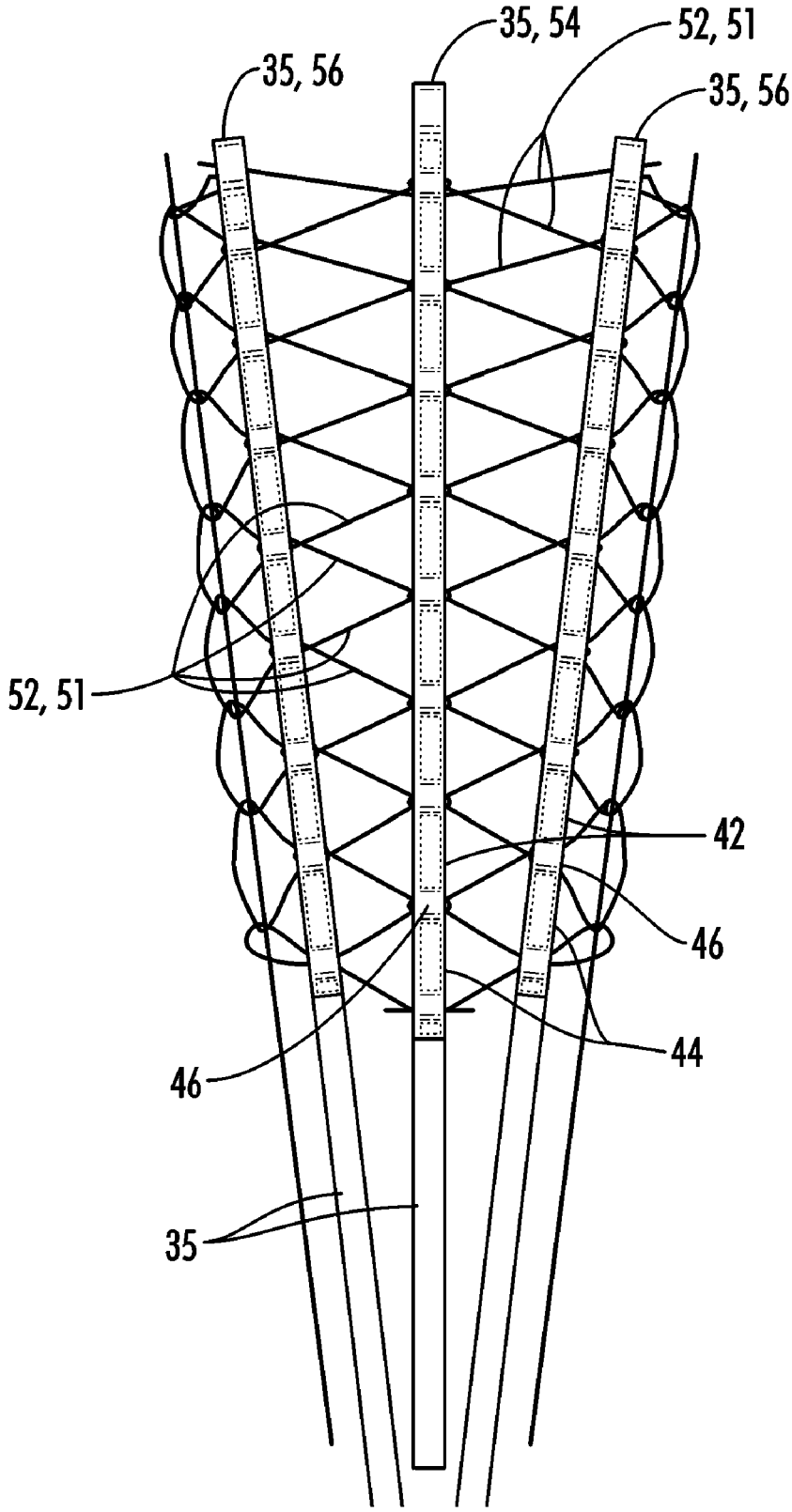
FIG. 8 is a front view of an embodiment of a lacrosse net made in accordance with the current disclosure.
Figure 9:
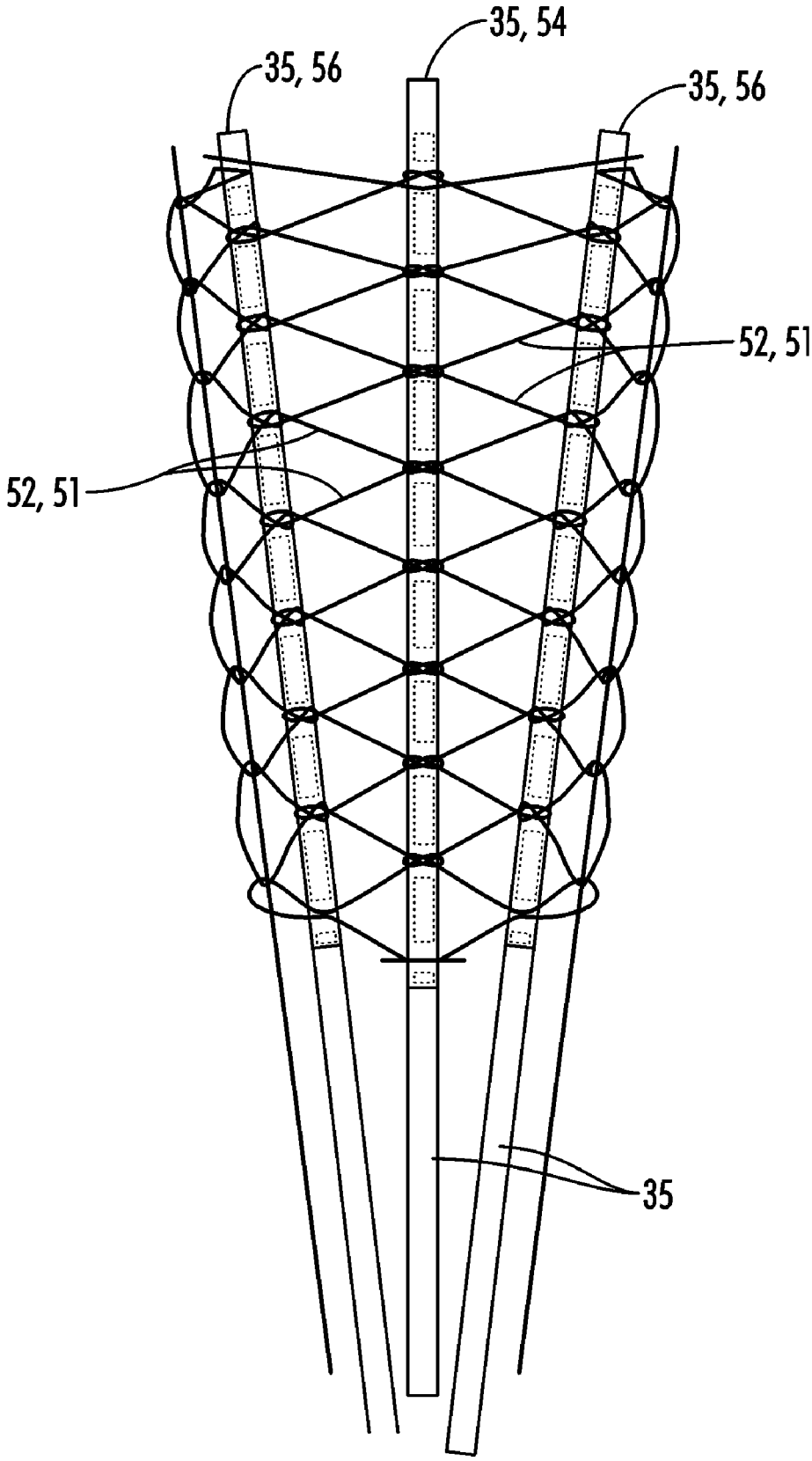
FIG. 9 is a front view similar to FIG. 8.

Alternately, the cross member 52 can be positioned in the opening 46 to restrict movement between a first runner 54 and a second runner 56. This type of cross member is also known as a cross piece 51, or a cross lace 51. The cross piece 51 is preferably strung between adjacent runners 36 and facilitates the pocket formation 34 and geometrical spacing between runners 54 and 56. The cross pieces 51 do not normally extend directly to the first or second sides 26 or 28. Instead a tie 58 is used to connect the cross pieces 51 to the first and second sides 26 and 28. Cross pieces 51 are best illustrated in FIGS. 8 and 9, while the ties 58 can be seen in FIGS. 1 and 3. FIGS. 2 and 4 show more detailed examples of cross pieces 51 passing through openings 46 of runners 54 and 56 to connect to runners 54 and 56. FIG. 4 shows the back of one of the runners 36 wherein the cross piece 51 is looped through the opening 46 and around the back to return to the adjacent runner 56. FIGS. 8 and 9 also illustrate these cross pieces 51. FIG. 9 shows the cross pieces 51 superimposed on the runners 36 to illustrate an example of the lacing of the cross pieces 51 and runners 36 through the openings 46 to establish the pocket 34 to be attached to the frame of a lacrosse head 20.

In an alternate embodiment the pocket 34 includes first and second runners 54 and 56 engaging the scoop of 22 and throat 24 wherein the first and second runners 54 and 56 are positioned substantially adjacent to one another. A tubular member 60 is positioned between the first and second runners 54 and 56 and a cross member 52 traverses the tubular members 60. The first runner 54 restricts movement of the tubular member 60 relative to the first side 26 while the second runner 56 restricts movement of the tubular member 60 relative to the second side 28. The cross member 52 can be a shooting string 53 and connect the first side 26 to the second side 28 of a lacrosse head 20. In this embodiment the shooting string 53 is adjusted relative to the first and second sides 26 and 28. Additionally, the shooting string 53 can traverse the lacrosse head 20 from the first side 26 to the second side 28 independent of the first and second runners 54 and 56, while facilitating adjustment of the first and second runners 54 and 56 between the front 30 and the back 32 of the lacrosse head 20. This movement facilitates a depth adjustment in the pocket 34 and allows a user of the lacrosse head 20 to individually adjust the playability of the lacrosse head 20.

Figure 10:
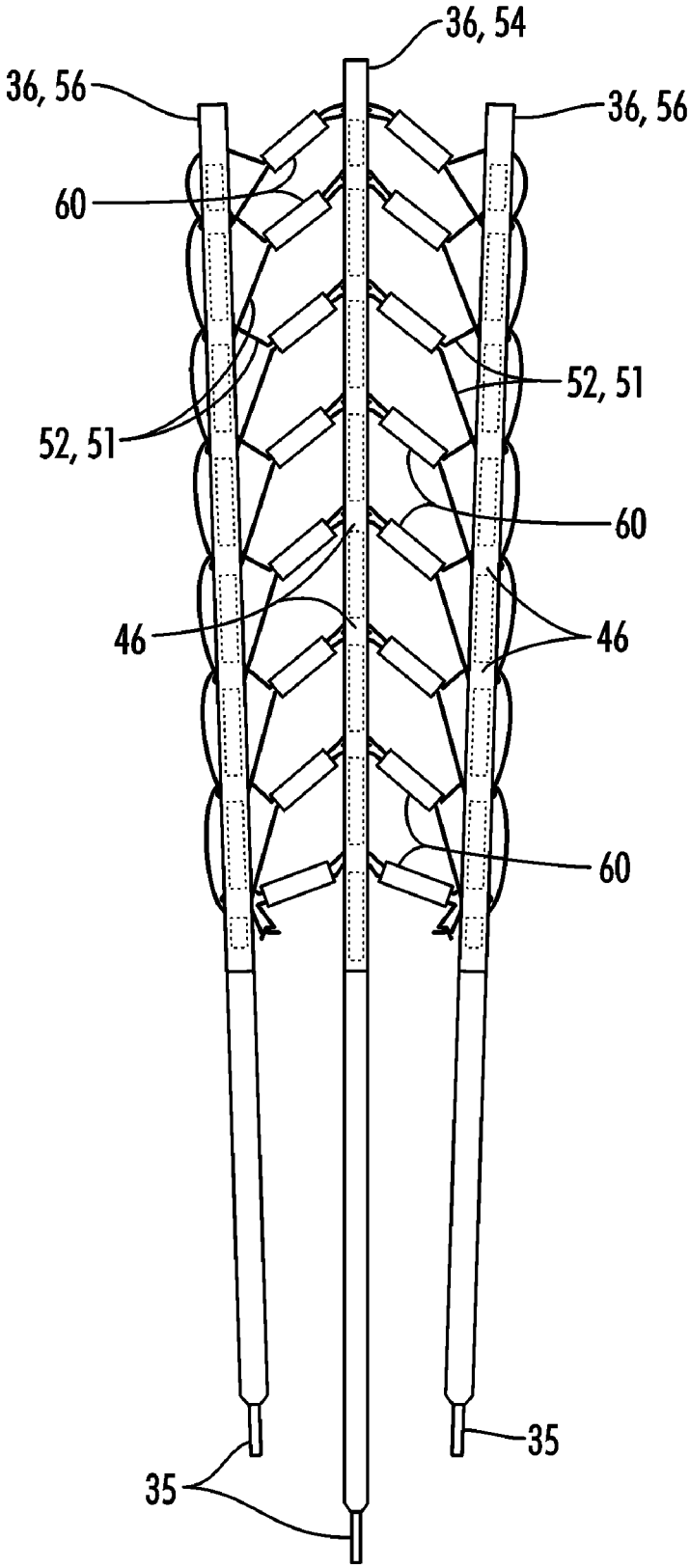
FIG. 10 is a front view of an alternate embodiment of a pocket made in accordance with the current disclosure.
Figure 11:
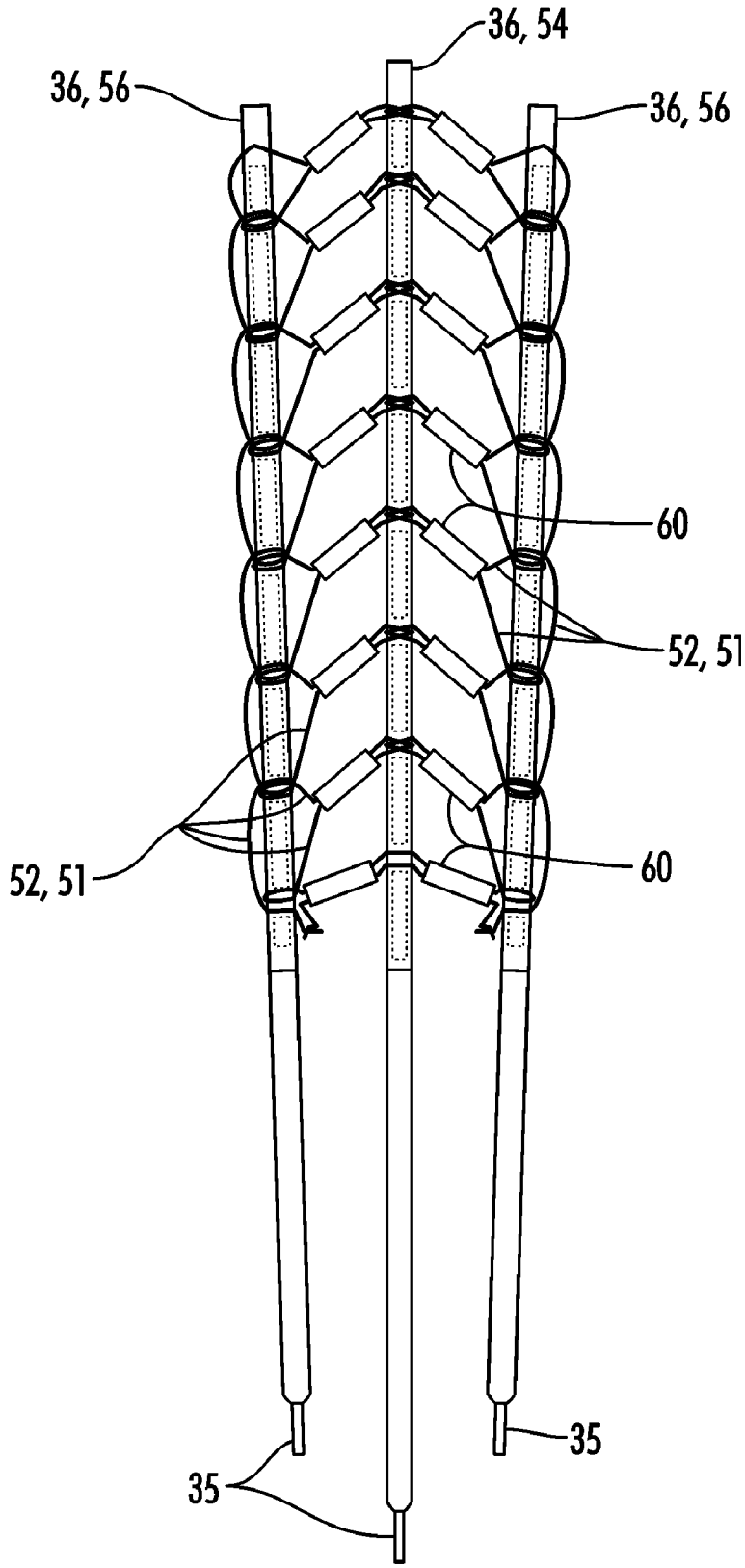
FIG. 11 is a front view similar to FIG. 10.
Figure 12:
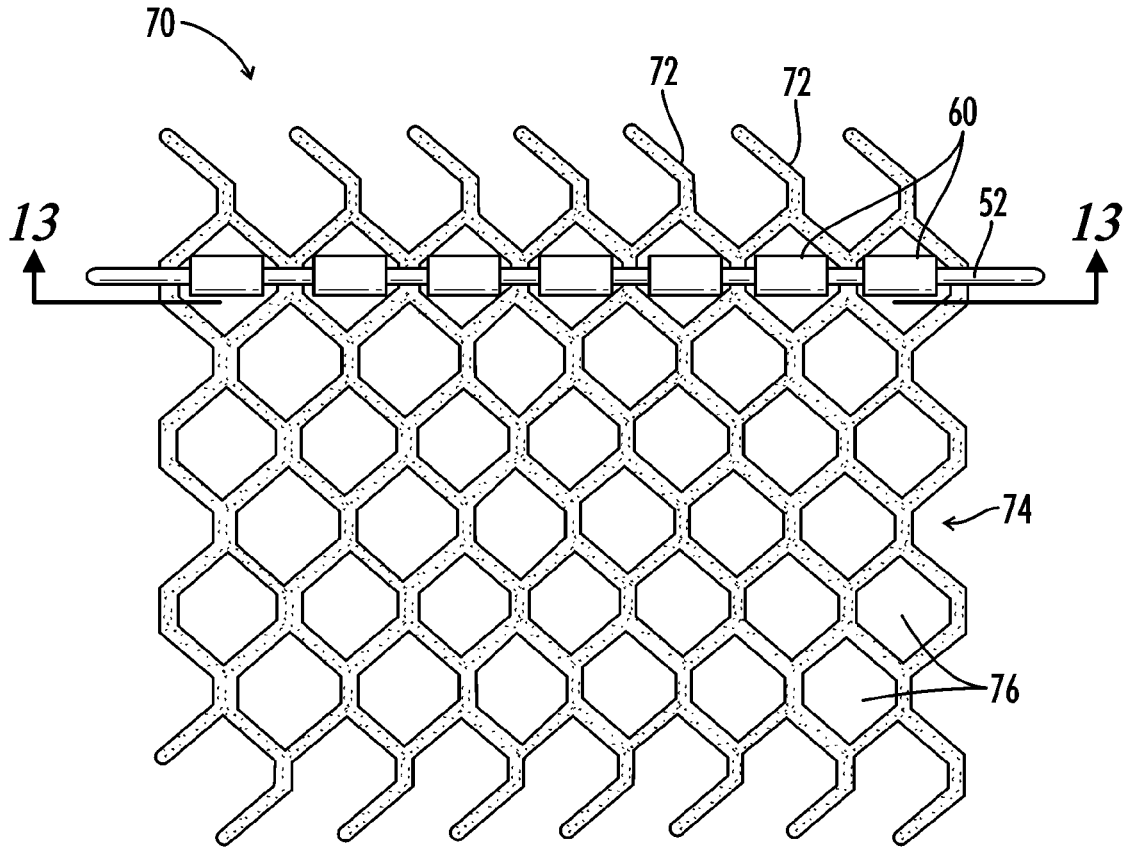
FIG. 12 is a schematic view of an alternate pocket made in accordance with the current disclosure.
Figure 13:
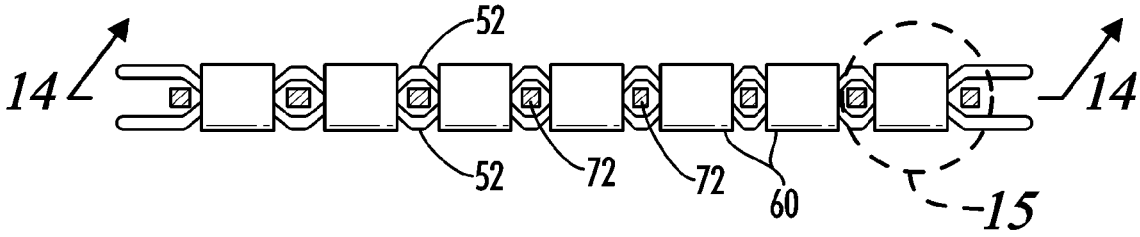
FIG. 13 is a cross sectional view taken along line 13-13 of FIG. 12.
Figure 14:
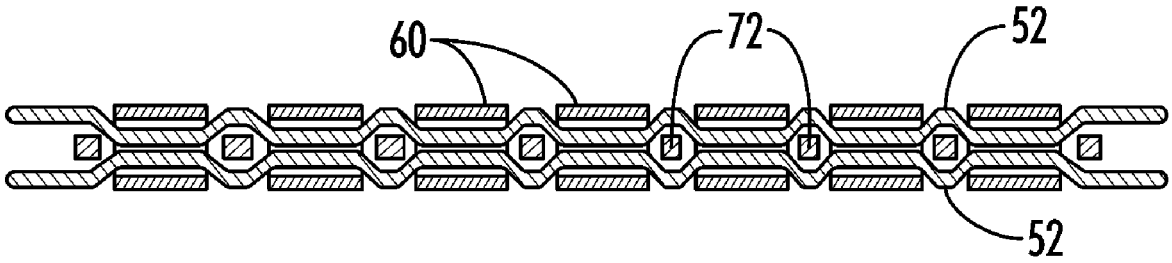
FIG. 14 is a cross sectional view taken along line 14-14 of FIG. 13.
Figure 15:
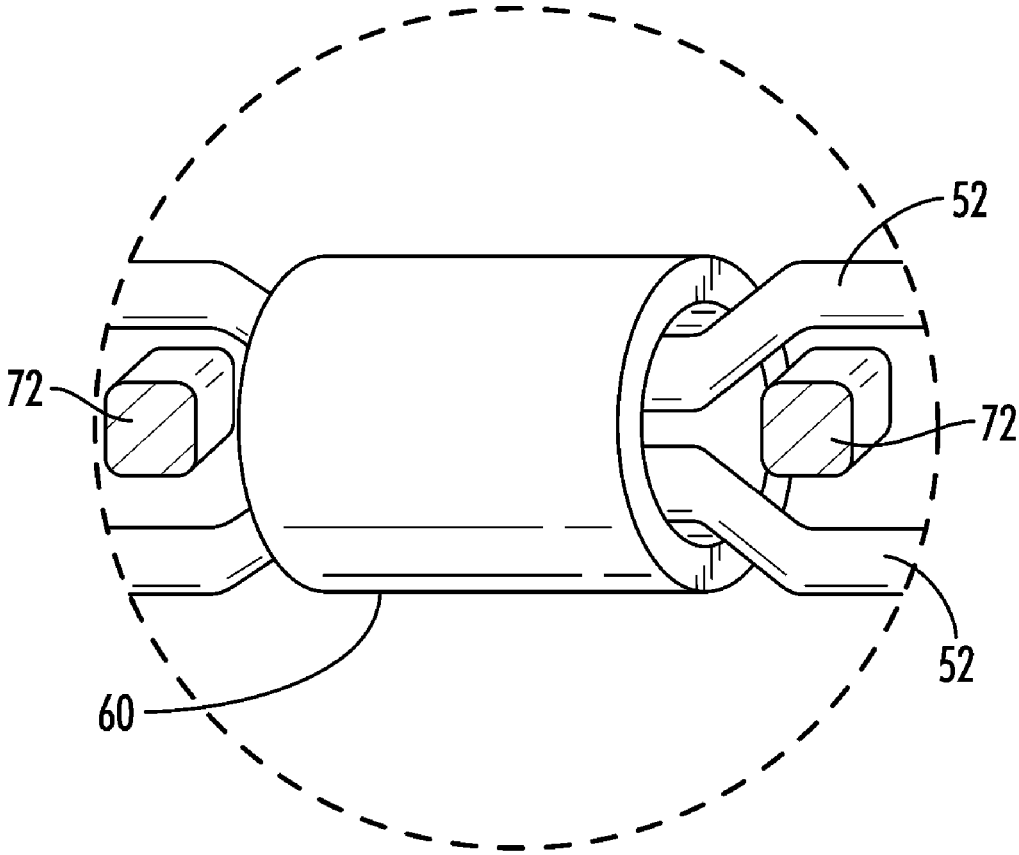
FIG. 15 is a detailed view of the area encompassed by the circle labeled as "15" in FIG. 13.
Figure 16:
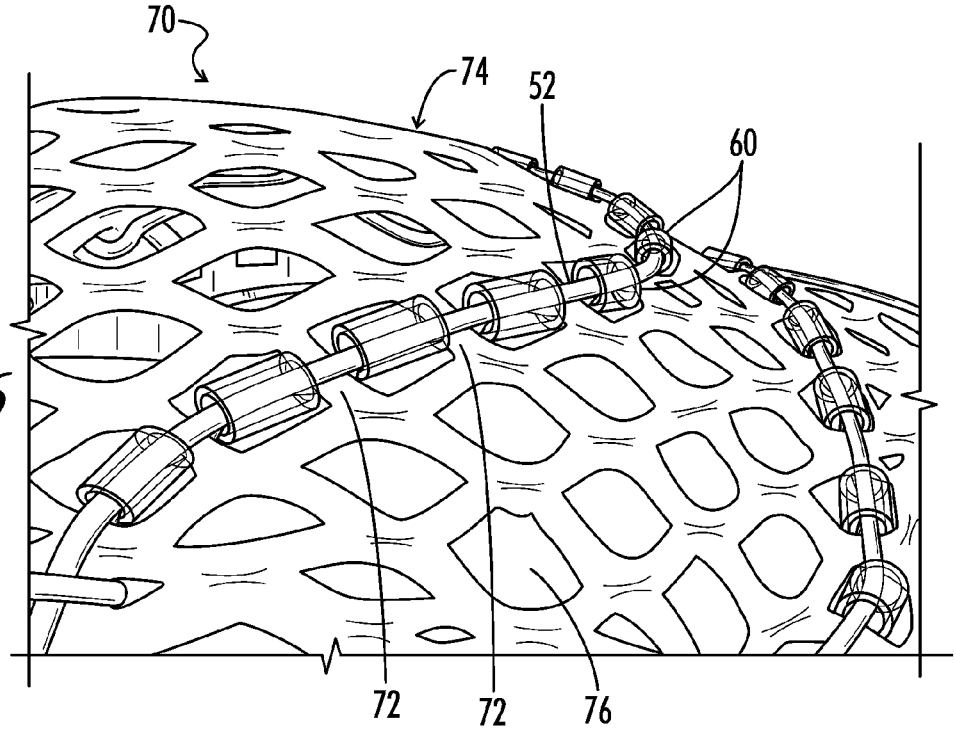
FIG. 16 is a detailed view of the back of a lacrosse head having tubular type members positioned in between runners and a mesh-type lacrosse pocket.
Figure 17:
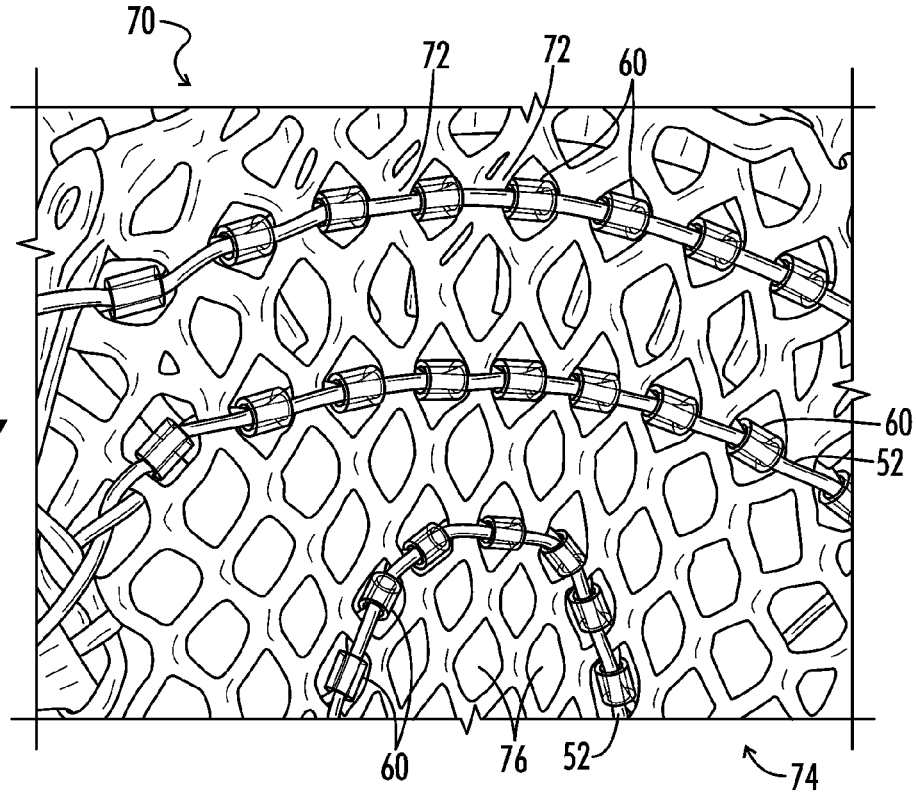
FIG. 17 is a detailed front view of the tubular type members positioned between runners in a mesh-type lacrosse head.
Figure 18:
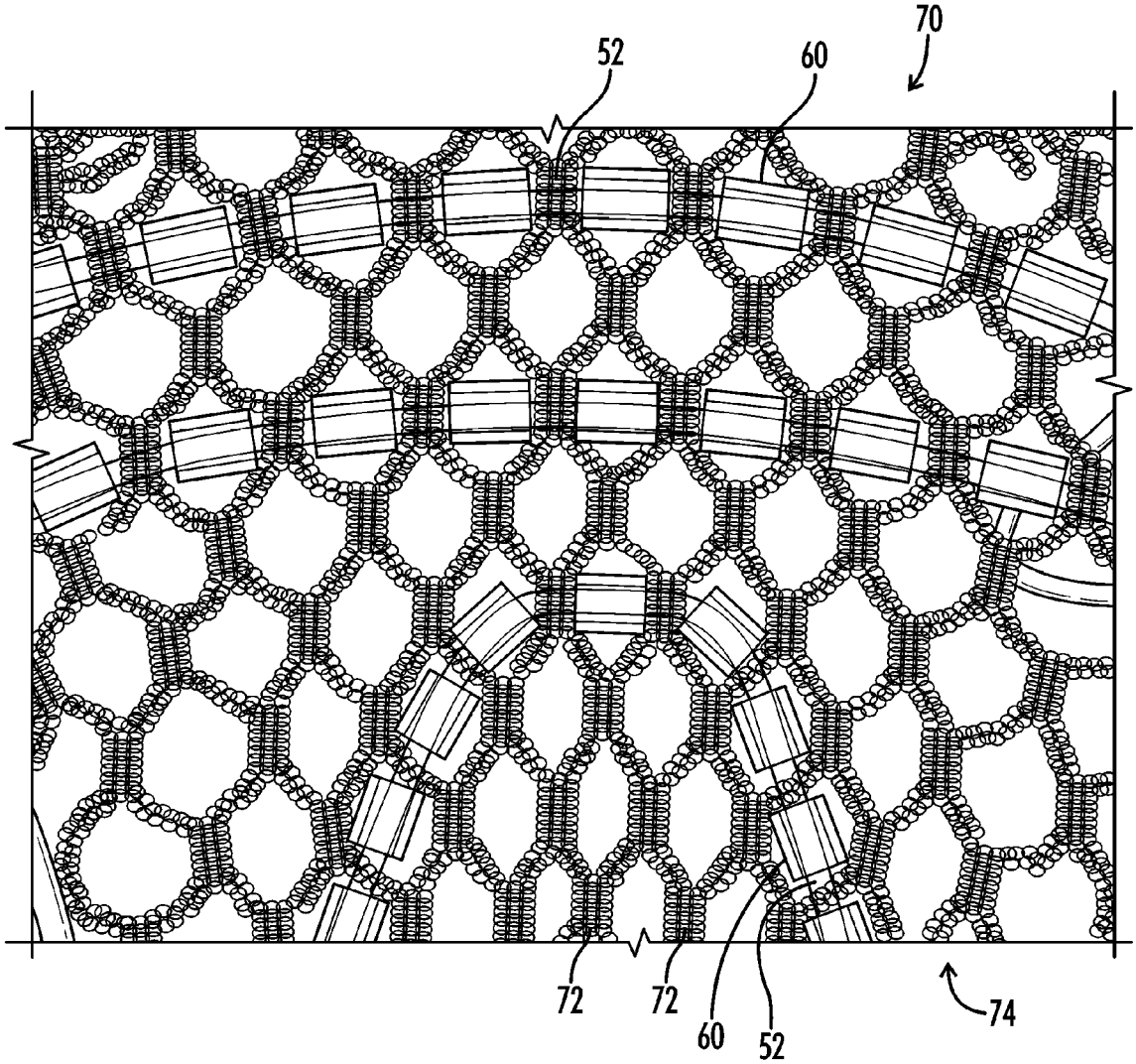
FIG. 18 is a detailed view of an alternate lacrosse net showing tubular members between runners in an alternate mesh-type lacrosse pocket.

Alternately, the cross member 52 can be a cross piece 51 that engages the first runner 54 to the second runner 56. This cross piece 51 restricts movement of the first runner 54 relative to the second runner 56. These cross members 52 can still pass through openings 46 in the runners 36 to substantially establish the overall pocket 34 used in the lacrosse head 20. The tubular member 60 facilitates easier adjustment of the pocket 34, easier stringing, or establishment, of the pocket 34. The easier adjustment and easier stringing is facilitated through the tubular member 60 by the fact that the tubular member 60 can position the cross members 52 in a desired location without the need of numerous loops of the cross member 52 around the runners 36. This is better understood by the fact that the traditional stringing of a lacrosse pocket requires cross pieces to be wrapped around the runners numerous times. This numerous wrapping is normally required to be basically undone in order to readjust the pocket. The tubular member 60 reduces this handling of the cross pieces 51 by substantially positioning the cross pieces 51 and the runners 36 with minimal interaction between the two. This is best illustrated in FIGS. 10 and 11.

The tubular members 60 also provide substantially uniform raised surfaces in the spaces between the runners 36. This provides resistance to the lacrosse ball and gives a better feel to the user of the lacrosse head 20. As such, with the use of the tubular members 60 a user can receive better feedback from the lacrosse head 20 in order to better comprehend the location of the ball within the lacrosse head 20 and know when the ball has been released from the lacrosse head. The fact that tubular members 60 are positioned between the runners 36, as opposed to extending across the runners 36, facilitates a more uniformed control and surface throughout the pocket 34 of the lacrosse head 20. This once again facilitates better control, shooting, and passing of the lacrosse ball from the lacrosse head 20.

The runners 36 can include extensions 35, which can be described as tie-ins 35, facilitating attachment of the runners 36 to the throat 24. Preferably these extensions 35 are comprised of the second material 50 and extend past the first material 48.

An alternate embodiment of the pocket is shown in FIGS. 12-18 and is generally designated by the numeral 70. This pocket 70 can be described as a mesh pocket wherein the adjacent runners form honeycomb shaped openings between the scoop 22 and throat 24. These adjacent runners also form honeycomb shaped spacing between the first side 26 and second side 28. This pocket 70 includes tubular members 60 positioned between adjacent runners 72. In this embodiment the pocket 70 includes at least two shooting strings 53 traversing each tubular member 60 to secure the tubular member 60 in place between the adjacent runners 72.

Alternately described this pocket 70 includes a mesh 74 with a plurality of apertures 76. Tubular members 60 are positioned in the aperture 76 and held in place by the mesh 74 and a plurality of cross members 52. The cross members engage the sides 26 and 28 of the lacrosse head 20 to allow a user to adjust the tension and depth in the pocket 70.

Figure 19:
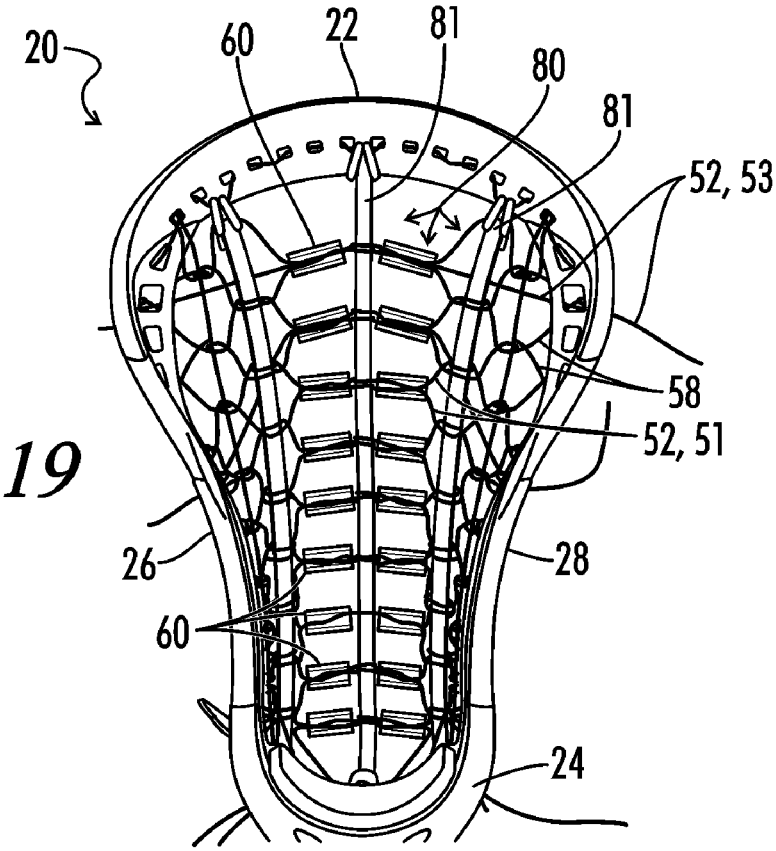
FIG. 19 is a front view of a lacrosse head having traditional type runners with tubular members positioned between the runners.
Figure 20:
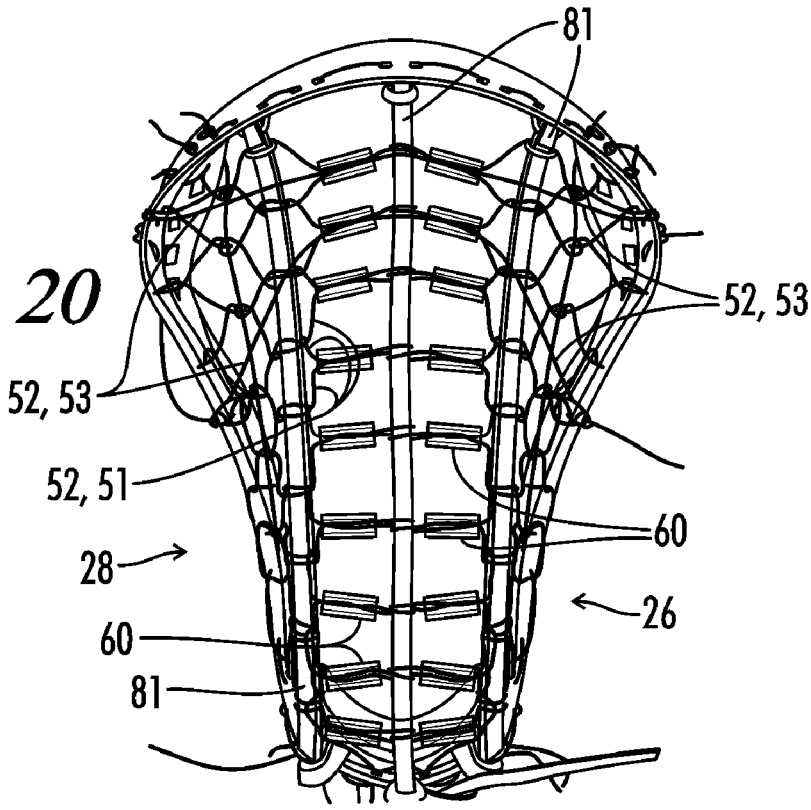
FIG. 20 is a back view of the lacrosse head shown in FIG. 19.
Figure 21:
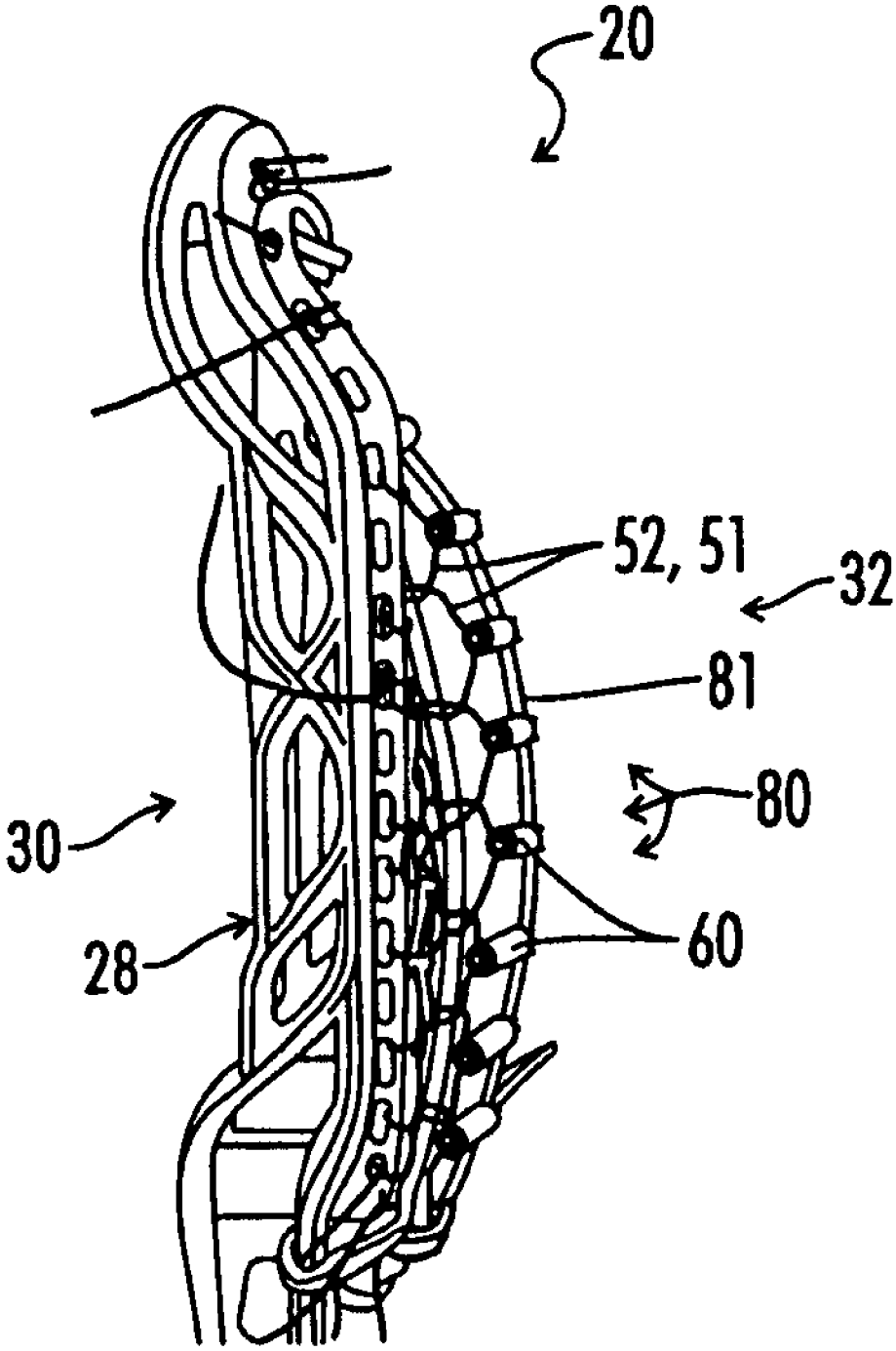
FIG. 21 is a side view of the lacrosse head shown in FIGS. 19-20.

In an alternate embodiment the lacrosse head 20 uses traditional runners 80 in conjunction with tubular members 60. The lacing of the alternate pocket 80 with the traditional runners 81 can be by conventional means. An example of this pocket 81 is best illustrated in FIGS. 19-21.

Thus, although there have been described particular embodiments of the present invention of a new and useful Lacrosse Pocket Having Shooting String Guide Tubes Between The Runners, it is not intended that such references be construed as limitations upon the scope of this invention except as set forth in the following claims.

What is claimed is:

1. A pocket for a lacrosse head, the lacrosse head including a scoop, a throat, a first side, a second side, a front and a back, the pocket comprising:

a first runner engaging the scoop and the throat;

a second runner engaging the scoop and the throat and positioned substantially adjacent to the first runner;

each runner includes a first layer attached to a second layer, first and second sections, and at least one opening positioned between the first and second sections, the at least one opening spacing the first layer from the second layer;

at least one tubular member positioned between the first and second runners; and at least one cross member traversing the at least one tubular member.

2. The pocket of claim 1, wherein the first runner restricts movement of the at least one tubular member relative to the first side and the second runner restricts movement of the at least one tubular member relative to the second side.

3. The pocket of claim 1, wherein the at least one cross member is connected to the first side and the second side of the lacrosse head.

4. The pocket of claim 3, wherein the at least one cross member moves relative to the first and second sides independent of the first or second runner.

5. The pocket of claim 1, wherein the at least one cross member engages the first runner to the second runner.

6. The pocket of claim 5, wherein the at least one cross member restricts movement of the first runner relative to the second runner.

7. The pocket of claim 1, wherein the at least one cross member is connected to the first side and the second side of the lacrosse head and moves relative to the first and second sides independent of the first and second runner.

8. The pocket of claim 1, wherein the at least one cross member engages the first runner to the second runner and restricts movement of the first runner relative to the second runner.

9. The pocket of claim 1, wherein the first layer is sewn to the second layer adjacent to the at least one opening.

10. The pocket of claim 1, wherein the each layer includes a polyurethane material substantially covering a braided material.

11. The pocket of claim 1, wherein the at least one cross member is attached to the at least one opening and connects the first runner to the second runner.

12. The pocket of claim 1, wherein the at least one cross member passes through the at least one opening and is connected to the first side and the second side of the lacrosse head.

13. A pocket for a lacrosse head, the lacrosse head including a scoop, a throat, a first side, a second side, a front and a back, the pocket comprising:

a first runner engaging the scoop and the throat;

a second runner engaging the scoop and the throat and positioned substantially adjacent to the first runner;

each runner includes a first layer attached to a second layer, first and second sections, and at least one opening positioned between the first and second sections, the at least one opening spacing the first layer from the second layer;

a plurality of tubular members positioned between the first and second runners; and at least one cross member traversing each tubular member.

14. The pocket of claim 13, wherein the cross members are connected to the first side and the second side of the lacrosse head and move relative to the first and second sides independent of the first and second runner.

15. The pocket of claim 13, wherein the cross members engage the first runner to the second runner and restricts movement of the first runner relative to the second runner.

* * * * *